US009995083B2

(12) United States Patent
Colson et al.

(10) Patent No.: US 9,995,083 B2
(45) **Date of Patent: *Jun. 12, 2018**

(54) COVERING FOR ARCHITECTURAL OPENING INCLUDING THERMOFORMABLE SLAT VANES

(75) Inventors: Wendell B. Colson, Weston, MA (US); Paul G. Swiszcz, Niwot, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/111,680

(22) PCT Filed: Apr. 13, 2012

(86) PCT No.: PCT/US2012/033674

§ 371 (c)(1),
(2), (4) Date: Oct. 14, 2013

(87) PCT Pub. No.: WO2012/142522

PCT Pub. Date: Oct. 18, 2012

(65) Prior Publication Data

US 2014/0034251 A1 Feb. 6, 2014

Related U.S. Application Data

(60) Provisional application No. 61/476,187, filed on Apr. 15, 2011.

(51) Int. Cl.
*E06B 9/08* (2006.01)
*E06B 9/68* (2006.01)
(Continued)

(52) U.S. Cl.
CPC ..... *E06B 9/68* (2013.01); *A47H 23/04* (2013.01); *E06B 9/262* (2013.01); *E06B 9/264* (2013.01);
(Continued)

(58) Field of Classification Search
CPC ..... E06B 9/40; E06B 9/15; E06B 9/38; E06B 2009/2429; E06B 2009/2627
(Continued)

(56) References Cited

U.S. PATENT DOCUMENTS 496,204 A 4/1893 Perry
1,962,868 A 6/1934 Gregg
(Continued)

FOREIGN PATENT DOCUMENTS

CN 1918356 6/2005
CN 2703855 Y 6/2005
(Continued)

OTHER PUBLICATIONS

International Search Report dated Jul. 17, 2012, PCT Application No. PCT/US2012/33670, 3 pages.
(Continued)

*Primary Examiner* — Katherine W Mitchell
*Assistant Examiner* — Jeremy C Ramsey

(57) ABSTRACT

A covering for an architectural opening including a support tube and a panel operably connected to the support tube and configured to be wound around the support tube. The panel includes a support sheet and at least one vane or slat connected to the support sheet. The at least one vane includes a vane material operably connected to a first side of the support sheet and a support member operably connected to the vane material and configured to support the vane material at a distance away from the support sheet when the panel is in an extended position with respect to the support tube.

31 Claims, 10 Drawing Sheets

(51) Int. Cl.

| | |
|---|---|
| ***E06B 9/34*** | (2006.01) |
| ***E06B 9/262*** | (2006.01) |
| ***E06B 9/386*** | (2006.01) |
| ***A47H 23/04*** | (2006.01) |
| ***E06B 9/40*** | (2006.01) |
| ***E06B 9/264*** | (2006.01) |
| ***E06B 9/36*** | (2006.01) |
| *E06B 9/24* | (2006.01) |
| *E06B 9/322* | (2006.01) |

(52) U.S. Cl.
CPC ..... *E06B 9/34* (2013.01); *E06B 9/36* (2013.01); *E06B 9/386* (2013.01); *E06B 9/40* (2013.01); *E06B 9/322* (2013.01); *E06B 2009/2429* (2013.01); *E06B 2009/2625* (2013.01); *E06B 2009/2627* (2013.01)

(58) Field of Classification Search
USPC ..... 160/108, 120, 121.1, 122
See application file for complete search history.

(56) References Cited

U.S. PATENT DOCUMENTS 2,012,887 A 8/1935 Major
2,024,090 A 12/1935 Cadmus
2,042,002 A 5/1936 Hovey
2,200,605 A 5/1940 Pierce
2,231,778 A 2/1941 Swanson
2,267,867 A 12/1941 Kienle
2,267,869 A 12/1941 Loehr
2,620,869 A 12/1952 Friedman
3,467,037 A 9/1969 Frydryk
3,990,201 A 11/1976 Falbel
4,039,019 A 8/1977 Hopper
4,066,062 A 1/1978 Houston
4,078,323 A 3/1978 Baumgarten
4,157,108 A 6/1979 Donofrio
4,194,550 A 3/1980 Hopper
4,338,996 A 7/1982 Frank
4,359,079 A 11/1982 Bledsoe
4,382,436 A 5/1983 Hager
4,532,917 A 8/1985 Holdridge
4,535,828 A 8/1985 Brockhaus
4,550,758 A 11/1985 Johnson et al.
4,649,980 A 3/1987 Kunz
4,692,744 A 9/1987 Hickman
4,722,382 A 2/1988 Vecchiarelli
4,736,785 A 4/1988 Seuster
4,763,890 A 8/1988 Zimmerman
4,800,946 A 1/1989 Rosenoy
5,123,473 A 6/1992 Henkenjohann
5,129,440 A 7/1992 Colson
5,217,000 A 6/1993 Pierce-Bjorklund
5,273,096 A 12/1993 Thomsen
5,325,579 A 7/1994 Baier
D352,856 S 11/1994 Ford
5,391,967 A 2/1995 Domel et al.
5,419,385 A 5/1995 Vogel et al.
5,503,210 A * 4/1996 Colson et al. ..... 160/84.05
5,547,006 A * 8/1996 Auger ..... B29C 65/08 160/121.1
5,566,738 A 10/1996 Yadidya
5,600,974 A 2/1997 Schnegg et al.
5,603,368 A 2/1997 Colson et al.
5,638,881 A 6/1997 Ruggles et al.
5,787,951 A 8/1998 Tonomura et al.
5,797,442 A * 8/1998 Colson ..... B29C 53/40 160/236
5,845,690 A 12/1998 Colson et al.
5,876,545 A 3/1999 Swiszcz et al.
5,897,731 A 4/1999 Colson et al.
6,006,812 A 12/1999 Corey
6,057,029 A 5/2000 Demestre et al.
6,076,588 A 6/2000 Swiszcz et al.
6,094,290 A 7/2000 Crawford et al.
D439,785 S 4/2001 Throne
D440,102 S 4/2001 Colson et al.
D444,658 S 7/2001 Swiszcz et al.
6,257,302 B1 7/2001 Bednarczyk et al.
D446,416 S 8/2001 Throne
6,302,982 B1 10/2001 Corey et al.
6,354,353 B1 * 3/2002 Green et al. ..... 160/84.04
6,374,896 B1 4/2002 Moller
D459,933 S 7/2002 Goodman
6,470,950 B2 10/2002 Shimizu
6,484,390 B1 11/2002 Gouldson et al.
6,550,519 B2 4/2003 Green et al.
6,613,404 B2 9/2003 Johnson
6,688,369 B2 2/2004 Colson et al.
6,745,811 B1 6/2004 Nien
6,758,211 B1 7/2004 Schmidt
D496,204 S 9/2004 Tuzmen
6,792,994 B2 9/2004 Lin
D498,105 S 11/2004 Tyner
D503,578 S 4/2005 Boehm
6,981,509 B2 * 1/2006 Sharapov ..... B60J 11/02 114/361
7,058,292 B2 6/2006 Hirano
7,063,122 B2 6/2006 Colson et al.
7,100,666 B2 * 9/2006 Colson et al. ..... 160/236
7,111,659 B2 9/2006 Harper et al.
7,191,816 B2 3/2007 Colson et al.
7,409,980 B1 8/2008 Heissenberg
7,418,313 B2 8/2008 Devis et al.
7,513,292 B2 * 4/2009 Auger et al. ..... 160/84.05
7,549,455 B2 6/2009 Harper
7,588,068 B2 9/2009 Colson et al.
7,637,301 B2 12/2009 Forst Randle
7,708,047 B2 5/2010 Auger
D632,493 S 2/2011 Colson et al.
D636,204 S 4/2011 Elinson et al.
D640,472 S 6/2011 Colson et al.
7,971,624 B2 7/2011 Harper et al.
8,020,602 B2 9/2011 Smith et al.
D646,516 S 10/2011 Ehrsam
D657,176 S 4/2012 Stern
8,171,640 B2 5/2012 Colson et al.
8,261,807 B2 9/2012 Dann et al.
D668,090 S 10/2012 Colson et al.
D671,349 S 11/2012 Judkins
8,393,080 B2 3/2013 Ballard et al.
D686,433 S 7/2013 Marocco
8,496,768 B2 7/2013 Holt et al.
D691,397 S 10/2013 Colson et al.
D692,684 S 11/2013 Colson et al.
D693,600 S 11/2013 Jelic et al.
8,639,387 B2 1/2014 Byberg et al.
8,763,673 B2 7/2014 Jelic et al.
9,540,874 B2 1/2017 Colson et al.
2001/0037849 A1 11/2001 Corey et al.
2002/0088559 A1 1/2002 Green et al.
2004/0065416 A1 4/2004 Auger et al.
2004/0163773 A1 8/2004 Murray
2005/0205217 A1 9/2005 Harper et al.
2006/0179991 A1 8/2006 Nien et al.
2006/0191646 A1 8/2006 Harper et al.
2006/0207730 A1 9/2006 Berman et al.
2007/0074826 A1 * 4/2007 Jelic ..... A47H 23/04 160/84.05
2007/0088104 A1 4/2007 Hung
2008/0014446 A1 1/2008 Donea et al.
2008/0066277 A1 3/2008 Colson et al.
2008/0127598 A1 6/2008 Kallstrom
2008/0264572 A1 10/2008 Randle
2008/0303686 A1 12/2008 Mosbrucker
2009/0205789 A1 8/2009 Watkins et al.
2009/0321024 A1 12/2009 Harper et al.
2010/0126675 A1 5/2010 Jelic et al.
2010/0186903 A1 7/2010 Liang et al.
2010/0266801 A1 10/2010 Jahoda et al.
2010/0276088 A1 11/2010 Jelic et al.
2010/0276089 A1 11/2010 Jelic et al.

(56) References Cited

U.S. PATENT DOCUMENTS

| | | | |
|---|---|---|---|
| 2011/0088324 | A1 | 4/2011 | Wessel |
| 2011/0088852 | A1 | 4/2011 | Hu et al. |
| 2011/0094689 | A1 | 4/2011 | Dwarka |
| 2011/0133940 | A1 | 6/2011 | Margalit |
| 2011/0146922 | A1 | 6/2011 | Colson et al. |
| 2011/0170170 | A1 | 7/2011 | Boote |
| 2011/0220303 | A1 | 9/2011 | Colson |
| 2012/0038841 | A1 | 2/2012 | Taheri et al. |
| 2012/0118514 | A1 | 5/2012 | Hughes |
| 2012/0222722 | A1 | 9/2012 | Baruchi et al. |
| 2012/0241104 | A1 | 9/2012 | Huffer et al. |
| 2012/0318475 | A1 | 12/2012 | Glover |
| 2013/0038093 | A1 | 2/2013 | Snider |
| 2013/0098565 | A1 | 4/2013 | Colson et al. |
| 2013/0105094 | A1 | 5/2013 | Colson et al. |
| 2013/0128336 | A1 | 5/2013 | Dean et al. |
| 2013/0180676 | A1 | 7/2013 | Berman et al. |
| 2013/0240158 | A1 | 9/2013 | Chen |
| 2014/0053989 | A1 | 2/2014 | Colson et al. |
| 2015/0041072 | A1 | 2/2015 | Hsu et al. |
| 2016/0145938 | A1 | 5/2016 | Colson et al. |
| 2016/0356080 | A1 | 12/2016 | Colson et al. |

FOREIGN PATENT DOCUMENTS

| | | | |
|---|---|---|---|
| CN | 1246564 | C | 3/2006 |
| CN | 201194726 | Y | 2/2009 |
| CN | 101984889 | A | 3/2011 |
| DE | 70451 | | 8/1893 |
| DE | 2709207 | A1 | 9/1978 |
| DE | 3912528 | A1 | 10/1990 |
| EP | 0511956 | A1 | 3/1991 |
| EP | 0818601 | A1 | 1/1998 |
| EP | 1347148 | A2 | 9/2003 |
| EP | 2113626 | A2 | 11/2009 |
| GB | 1494842 | A | 12/1977 |
| JP | 08-511591 | A | 12/1996 |
| JP | 3832007 | B2 | 10/2006 |
| JP | 2007515577 | A | 6/2007 |
| TW | 310303 | B | 7/1997 |
| WO | 9704207 | A1 | 2/1997 |
| WO | 0206619 | A1 | 1/2002 |
| WO | 02/41740 | A1 | 5/2002 |
| WO | 03/008751 | A1 | 1/2003 |
| WO | 2005/062875 | A2 | 7/2005 |
| WO | 2005/098190 | A1 | 10/2005 |
| WO | 2009/103045 | A2 | 8/2009 |
| WO | 2010/059581 | A3 | 5/2010 |
| WO | 2011130593 | | 10/2011 |
| WO | 2012142519 | | 10/2012 |
| WO | 2012142522 | | 10/2012 |

OTHER PUBLICATIONS

International Search Report dated Aug. 1, 2012, PCT Application No. PCT/US2012/33674, 3 pages.

European Search Report dated Aug. 5, 2014 for European Patent Application No. 12771183.6, 7 pages.

U.S. App. No. 14/111,666, filed Oct. 14, 2013, Colson et al.

International Search Report, dated Oct. 29, 2014, PCT Application No. PCT/US2014/043035, 3 pages.

* cited by examiner

COVERING FOR ARCHITECTURAL OPENING INCLUDING THERMOFORMABLE SLAT VANES

CROSS-REFERENCE TO RELATED APPLICATIONS

The present application is the national stage application of International Patent Application No. PCT/US2012/033674, entitled "Covering For Architectural Opening Including Thermoformable Slat Vanes", filed Apr. 13, 2012, which claims priority to U.S. provisional patent application No. 61/476,187, filed Apr. 15, 2011, entitled "Shade with Bias to Open Cells," which is hereby incorporated by reference into the present application in its entirety. This application is also related to co-pending PCT International patent application No. PCT/US2012/033670, entitled "Covering for Architectural Opening Including Cell Structures Biased to Open," filed Apr. 13, 2012, which is incorporated in its entirety by reference as though fully disclosed herein.

INCORPORATION BY REFERENCE

The present application incorporates by reference in its entirety, as if fully described herein, the subject matter disclosed in the following PCT application: PCT International patent application No. PCT/US2011/032624, filed Apr. 15, 2011, entitled "A Process and System for Manufacturing a Roller Blind."

FIELD

The present disclosure relates generally to coverings for architectural openings, and more specifically, to retractable coverings for architectural openings.

BACKGROUND

Coverings for architectural openings such as windows, doors, archways, and the like have assumed numerous forms for many years. Early forms of such coverings consisted primarily of fabric draped across the architectural opening, and in some instances the fabric was not movable between extended and retracted positions relative to the opening. Some newer versions of coverings may include cellular shades. Cellular shades may include horizontally disposed collapsible tubes that are vertically stacked to form a panel of tubes. In these shades the panel is retracted and extended by lifting or lowering the lowermost cell. As the lowermost cell is lifted, it lifts the cells above it and collapses them atop one another. As the lowermost cell is lowered, the cells are pulled open. When in a refracted position, current cellular shades are stored in a stacked configuration, i.e., one cell on top of the other cells. This retracted configuration is required, since wrapping the cells around a roller tube may damage the cells and/or prevent cells from opening.

SUMMARY

The present disclosure includes a covering for an architectural opening. The covering of the architectural opening may include a support tube and a panel operably connected to the support tube. The support tube may be configured to support the panel from above or the side of the architectural opening. The panel is configured to be wound around the support tube. The rotation of the support tube is controlled by activation cords engaging a drive mechanism, which in turn engages the support tube. The panel includes a support sheet and at least one vane or slat operably connected to the support sheet. The vane or slat includes a first material operably connected to a first side of the support sheet and a support member operably connected to the first material and configured to support the first material at a distance away from the support sheet when the panel is an extended position with respect to the support tube.

In some examples, the covering may include a first vane and a second vane. The first vane includes a first support member and a first vane material operably connected to the first support member. The first vane material includes a first top portion, a first middle portion, and a first bottom edge. The first top portion is operably connected to the support sheet adjacent a first top edge of the first vane material defining a first leg, the first top portion extends downwards adjacent the support sheet and at a first inflection point transitions away from the support sheet to the first middle portion, the first middle portion transitions at a second inflection point to the first bottom edge. The second vane includes a second support member and a second vane material operably connected to the support member. The second vane material includes a second top portion, a second middle portion, and a second bottom edge. The second top portion is operably connected to the support sheet adjacent a second top edge of the second vane material defining a second leg, the second top portion extends downwards adjacent the support sheet and at a third inflection point transitions away from the support sheet to the second middle portion, the second middle portion transitions at a fourth inflection point to the second bottom edge.

Other examples of the present disclosure may take the form of a method for manufacturing a covering for an architectural opening. The method includes operably connecting a vane material and a support member, wrapping the vane material and the support member around a support tube, heating the vane material and the support member so that the support member forms a shape substantially the same as a shape of or corresponding to the support tube, cooling the vane material, the support member and the support tube.

Yet other examples of the present disclosure may take the form of a shade for an architectural opening. The shade includes a support sheet, a first vane operably connected to the support sheet, and a second vane operably connected to the support sheet. The first vane includes a first vane material operably connected at a first location to the support sheet and a first support member operably connected to the first vane material. The second vane includes a second vane material operably connected at a second location to the support sheet and operably connected at a third location to the first vane material and a second support member operably connected to the second vane material.

These and other aspects of embodiments of the disclosure will become apparent from the detailed description and drawings that follow.

SPECIFICATION

General Description

Figure 1:
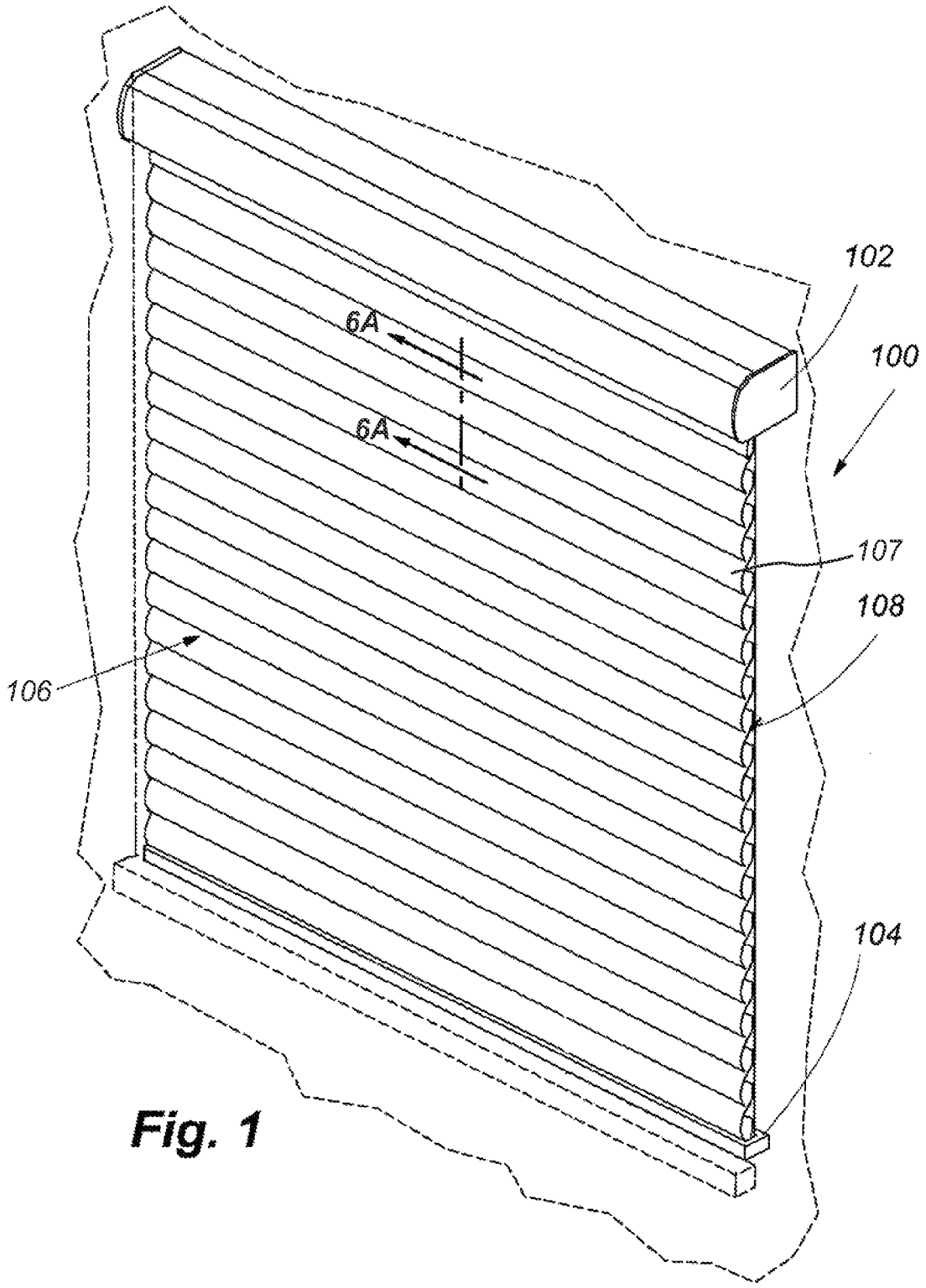
FIG. 1 is an isometric view of one embodiment of a panel for covering an architectural opening.

The present disclosure relates generally to a panel or covering for an architectural opening that may include one more slats or vanes that may form pseudo-cells operably connected to one or both sides of a support material or sheet. The panel or covering may be configured so that it may be retracted and expanded, and when in the retracted position the panel may be wound around a support tube, bar, rod, or the like. This allows the panel to provide some of the benefits of a cellular covering (e.g., insulation, aesthetic appeal) from the pseudo-cells, formed by the vanes, while at the same time providing the benefits of a non-cell shaped covering (e.g., hidden and compact storage). Specifically, by having a retracted position that allows the panel to be stored around a support tube, the covering may be stored from view behind a head rail. This is beneficial as prior art cellular shades typically are stored only in a vertically stacked position and thus would not be fully hidden from view in a head rail. Additionally, because the panel may be rolled onto a support tube, it may be protected by a head rail or other member from dust, sun damage (e.g., fading), and so on. Furthermore, in some embodiments, the panel may be retracted to a stacked position, alternatively to being wound around a support tube, thus the panel as described herein may have the option to be both stacked or rolled when in the retracted position.

Some embodiments of the panel may include pseudo-cells formed by slats or vanes that extend laterally and are positioned vertically relative to one another. Each slat may be operably connected to a support sheet by one or more connection mechanisms. In these instances, the vanes may define pseudo-cells. The pseudo-cells are defined by a combination of the support sheet and the vane material of the respective vane. In some embodiments, each vane or slat may be operably connected to the support sheet such that a top free portion or leg may extend past a point of connection between the vane and the support sheet. This leg may assist the vane in extending away from the support sheet as the panel is extended. Each vane may form a generally half tear-drop shaped in cross section, and extend length-wise across the panel. Each of the slats or vanes may include a support member that may be heat formed to a particular shape. For example, the support member may be a thermo-formable material that may become partially or substantially resilient after heating, and may retain desired a shape after cooling. The support member may be operably connected to the vane or slat material (e.g., fabric) and form an outer covering of the vane, or an inner covering of the vane. However, in some embodiments, the support member may be integrated with material forming each vane.

The panel may be formed by operably connecting the support member to a vane material and then wrapping both the vane material and the support member around a support tube, mandrel, or other forming member. The support tube, the vane material, and the support member may then be heated. As the components are heated, the support member may generally re-shape to conform generally to the shape of the support tube. After cooling, the vane material takes on the shape of the support member where the two are engaged. Then, the support tube and panel may be installed over an architectural opening.

It should be noted that embodiments herein may refer to a panel or shade for covering an architectural opening. However, the panels disclosed herein may be used in various manners. For example, the panels may be used as wall coverings, wallpaper, texture for walls, and so on.

The Panel

Figure 2:
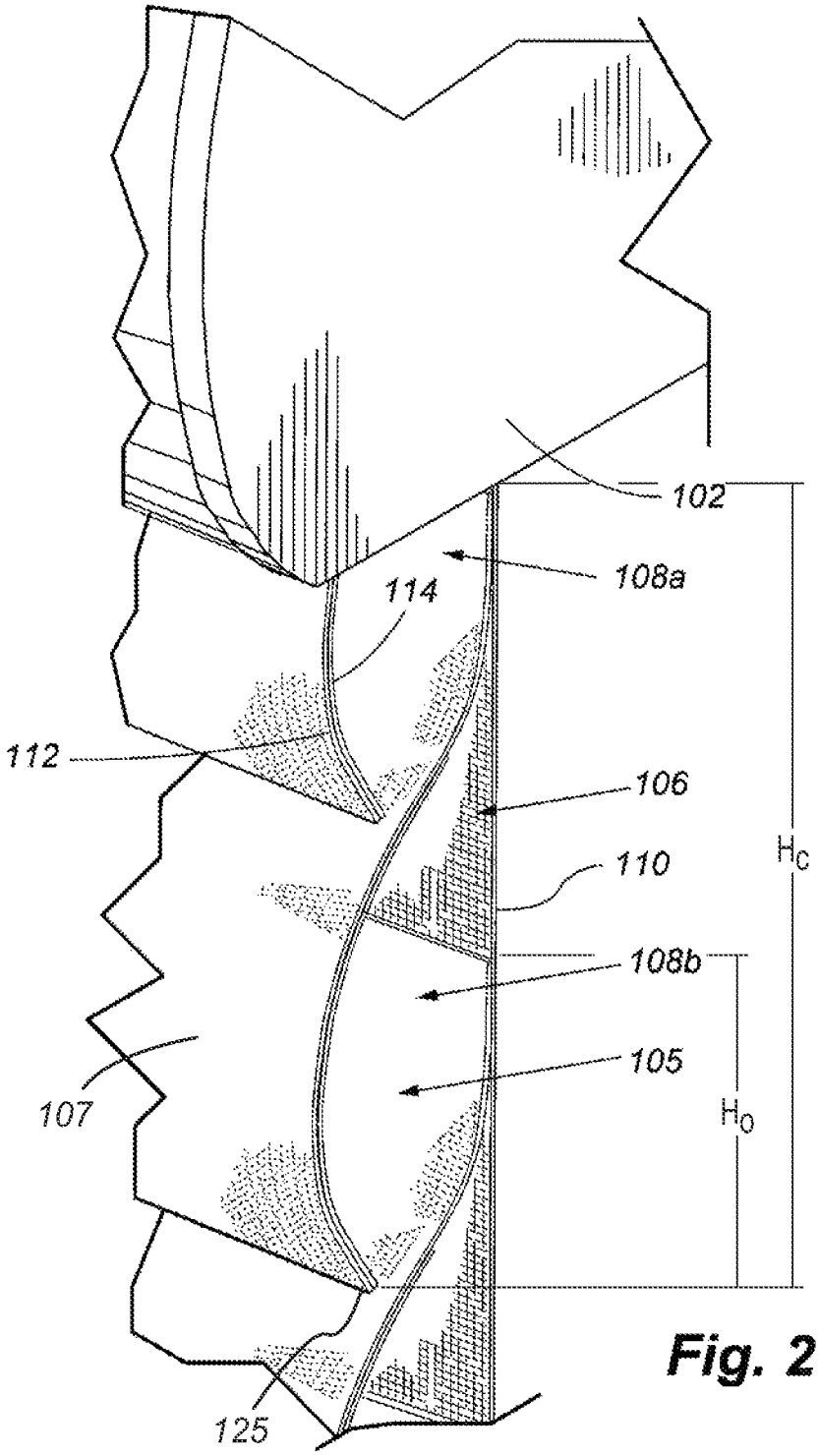
FIG. 2 is an enlarged isometric view of a first embodiment of the panel of FIG. 1.
Figure 3:
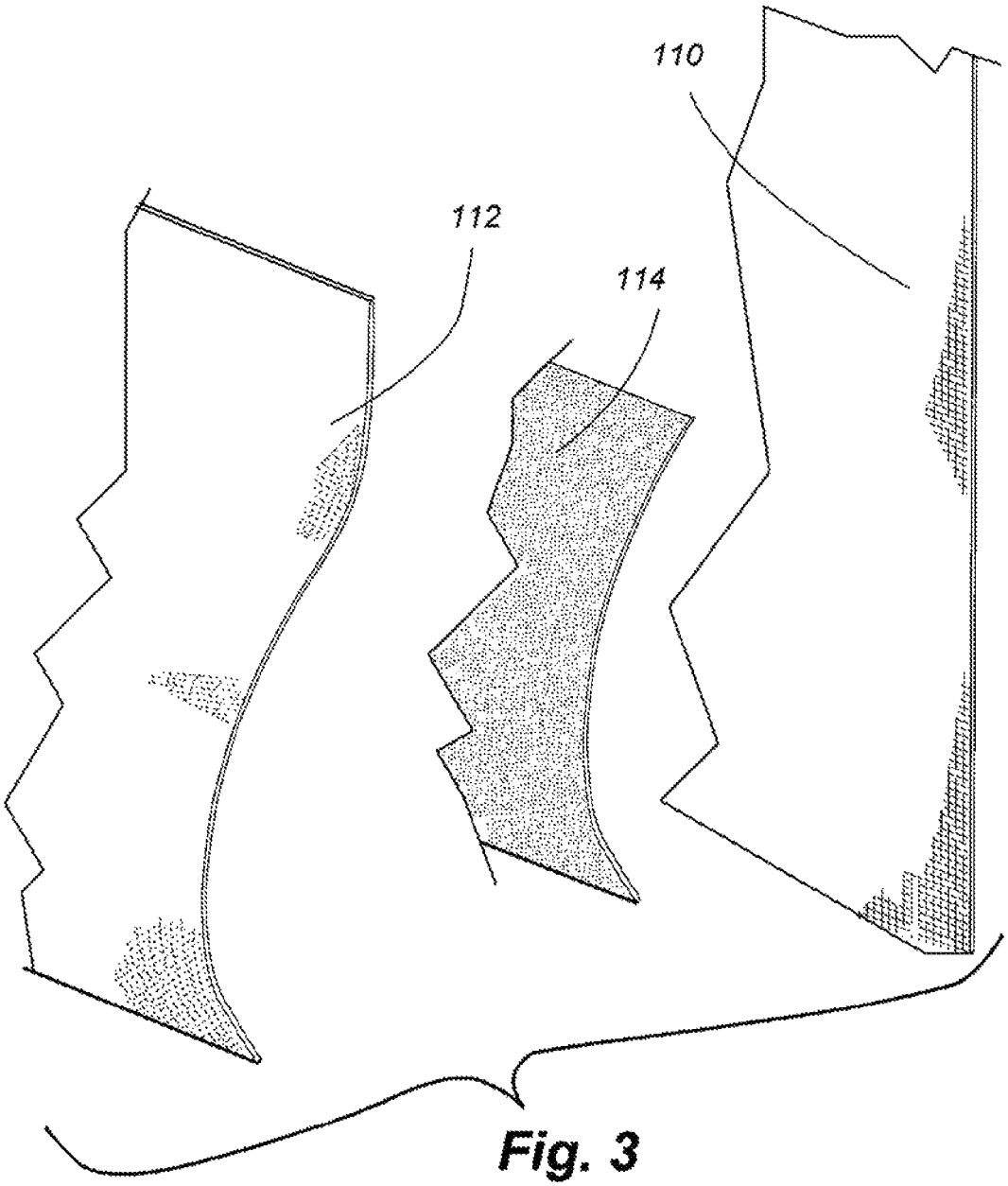
FIG. 3 is an exploded view of a vane forming a part of the panel illustrated in FIG. 2.

FIG. 1 is a front isometric view of a panel system 100. FIG. 2 is an enlarged isometric view of the panel system 100 of FIG. 1. FIG. 3 is an exploded view of a vane of the panel system 100 as shown in FIG. 2. The panel system 100 may include a head rail 102 or other support structure that can support a panel 106 and an end rail 104 over an architectural opening. A support tube or roller may be positioned in the head rail 102. The end rail 104 is operably connected to a terminal edge of the panel 106, and provides a weight to help tension the panel when extended. The panel 106 is configured to provide a covering for an architectural opening, such as a window, archway, etc.

The panel 106 may include a vanes 107 that may define plurality of pseudo-cells 108. For example, each of the pseudo-cells 108 may be defined at least in part by a support sheet 110, a vane material 112, and a support member 114. The vane material 112 and the support sheet 110 operably connected to one another to form a front side of the panel 106. In some embodiments, the vanes 107 may be stacked directly on top of another, and in other embodiments, the vanes 107 may be spaced apart from one another, depending on the desired appearance and/or light transmissivity of the panel 106. The vanes or slats 107 extend laterally across the panel 106. In other examples, the vanes 107 may extend vertically across the panel 106.

Figure 4:
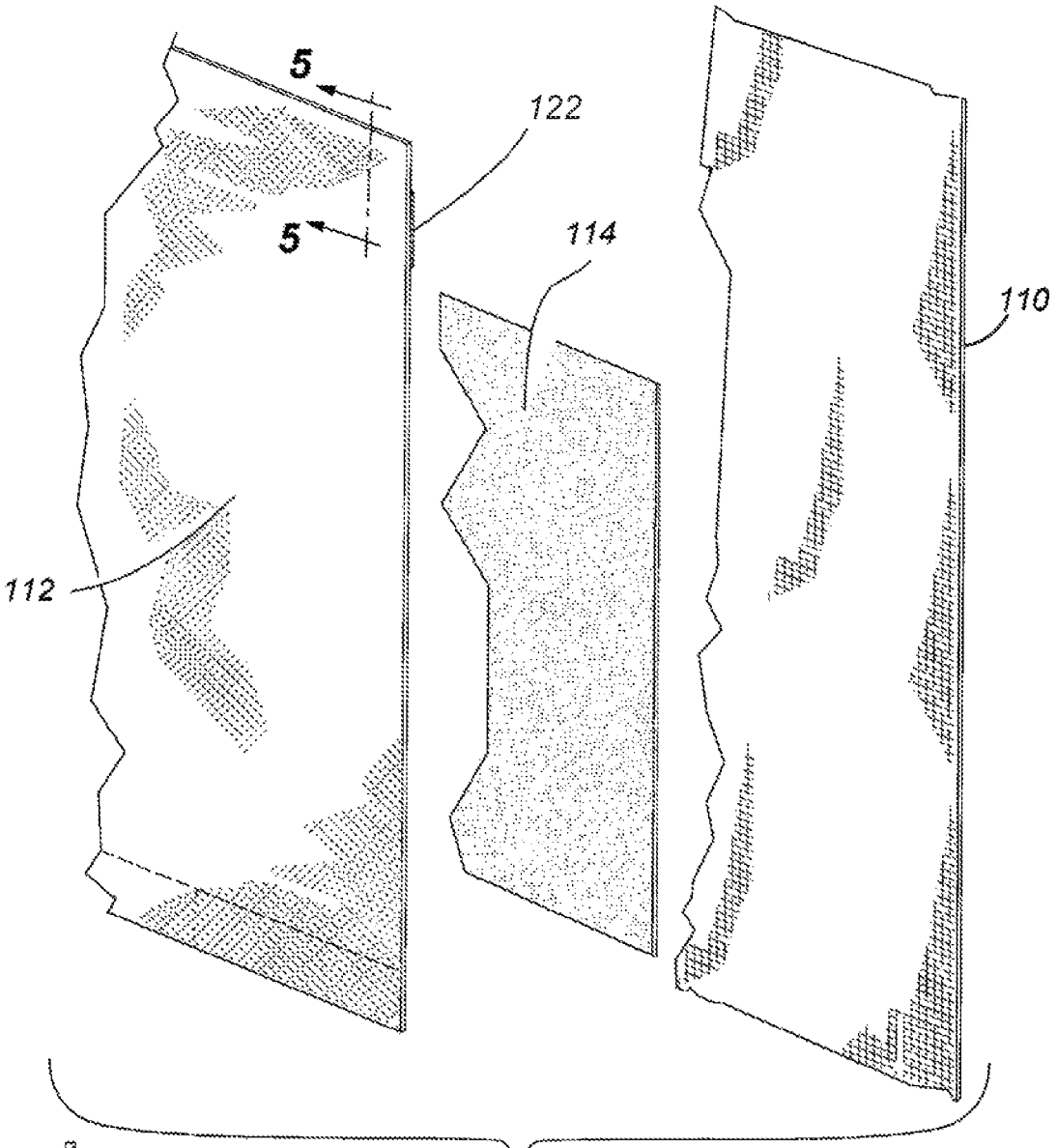
FIG. 4 is an exploded view of the vane of FIG. 1 prior to forming a support member.
Figure 5:
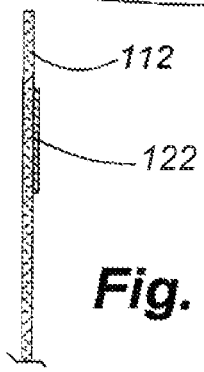
FIG. 5 is a cross-section view of a upper portion of a first material of the vane of FIG. 4 viewed along line 5-5 in FIG. 4.

In addition to the vane material 112, as shown in FIGS. 2 and 3, the vanes 107 or slats may include a support member 114 that may be resilient so as to allow the vanes 107 to form around a roller or support tube and spring or bias away from the support sheet 110 when the panel 106 is extended. The vanes may be considered to be "collapsed" where the support sheet and the vane are positioned to be closely adjacent to one another (or in contact or in partial contact) while on the roller in the retracted position. In the act of collapsing, the support member may deflect from its formed curvature by a slight amount, or by a large amount, or it may not deflect appreciably. The pseudo cells 108 collapse when rolled up on the head roller or tube because, in one example, the support member rolls up on the tube at a diameter approximately equal to set curvature of the support member. If the support member were quite stiff, it would stay at substantially the same shape, rolled or not rolled. The vanes and thus the pseudo cells would then be collapsed to the roller when rolled up, and opened by the support members curvature when the shade is unrolled or straightened out. The curvature of the support members would match or approximately match the curvature with which each was formed. The support member 114 will be discussed in more detail below. Briefly, the support member 114, which may be formed to determine the shape and height of the vanes 107, and, as shown in FIGS. 4-5, may have a first shape prior to forming and, as shown in FIGS. 2 and 3, may have a second shape after forming. The forming of the support member 114 will be discussed in more detail below.

Figures 6A, 6B:
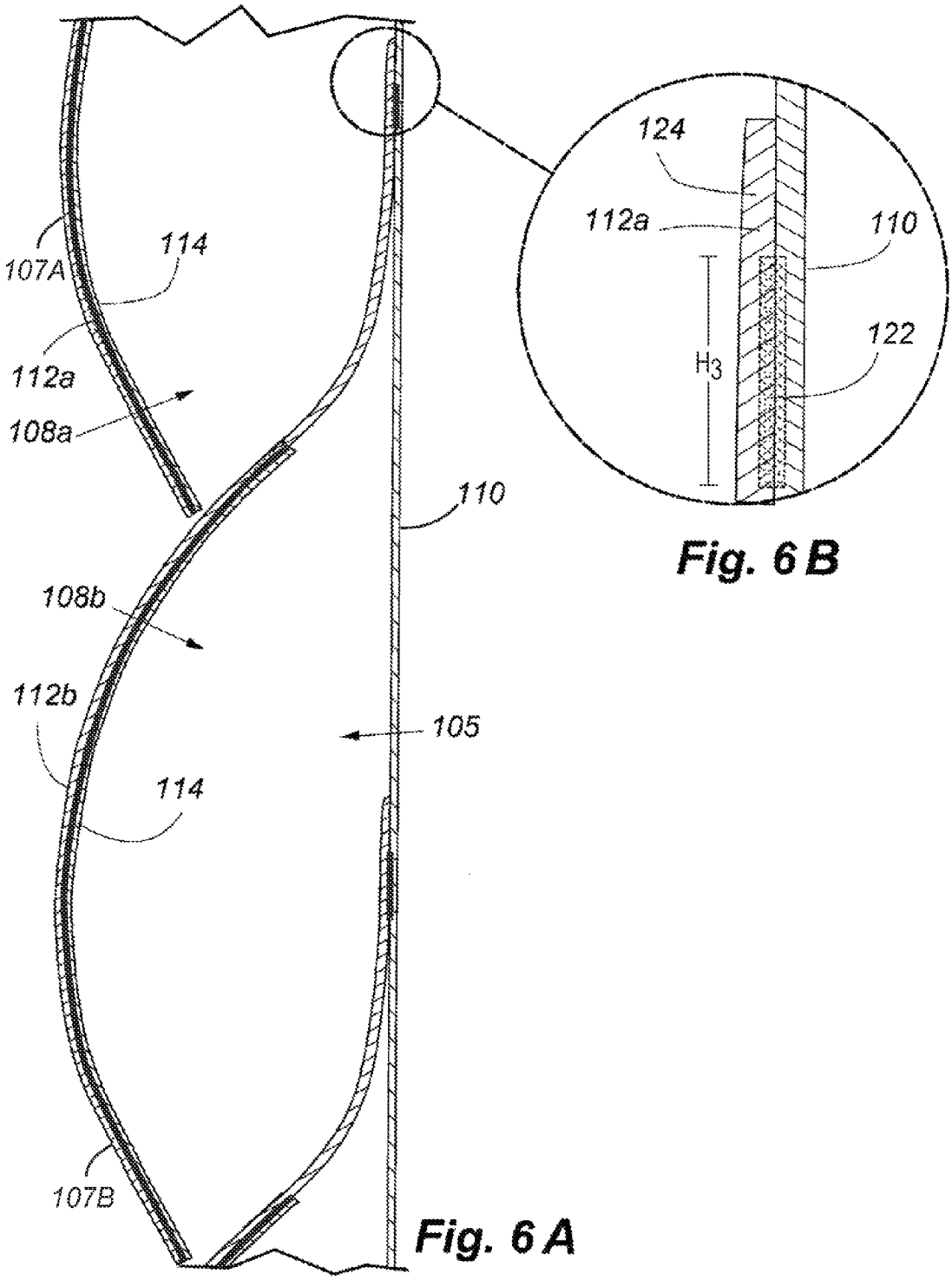
FIG. 6A is an enlarged view of cross-section view of the panel illustrated in FIG. 1 taken along line 6A-6A in FIG. 1.
FIG. 6B is an enlarged view of the panel of FIG. 6A illustrating a sheet connection between the first material and a support sheet.

The panel system 100 will now be discussed in more detail. FIG. 6A is a cross section view of the panel system 100 taken along line 6A-6A in FIG. 1. FIG. 6B is an enlarged view of the vane material 112 operably connected to the support sheet 110. The vanes 107 are configured so that each vane 107 may extend outwards away from the support sheet 110 as well as may collapse and wind up in layers on the support tube 116. A support tube 116 (see FIG. 8) may be supported within the head rail 102, such that the head rail 102 may substantially cover or conceal the entire or a substantial portion of the support tube 116 and extend and retract the shade. The head rail 102 may include an opening through which the panel 106 may extend. With brief reference to FIG. 8, the support tube 116 may be positioned within the head rail 102 such that the panel 106 may be raised and lowered with respect to the head rail 102 through the opening. For example, as the panel 106 is extended, the support tube 116 will roll, unwinding the panel 106, which may then pass through the opening past the head rail 102. Similarly, when the panel 106 is retracted, the support tube 116 will roll in an opposite direction, winding the panel 106 further around the support tube 116, retracting the panel 106 through the opening. Alternatively or additionally, the end rail 104 may be raised towards the head rail 102 and the panel 106 may stack underneath rather than roll around the support tube 116.

With reference to FIGS. 2 and 6A, the shape of the vanes 107 and attachment to the support sheet 110 may define the pseudo-cells 108 that each define an inner chamber 105 or void space, which is expanded when the panel 106 is in the extended position and collapsed when in the retracted position (either rolled around the support tube 116, or stacked). For example, in the "collapsed" position, the support sheet may be pressed against a length of the vane 107 and in the expanded position the support sheet may be spaced apart from the same length of the vane 107 by a predetermined distance. The panel 106 may be attached to the support tube 116 by an adhesive positioned between the top edge of the panel and a line extending longitudinally along the length of the support tube. Other attachment means may also be used, such as double-sided tape, rivets, or even a top hem positioned within a receiving slot. The panel 106 may be connected to the support tube 116 by a separate piece of material, plastic, or even laterally spaced cords or discrete links.

With reference to FIGS. 2, 6A, and 6B, the pseudo cells 108 may be defined at least in part by the support sheet 110, the vane material 112 and the support member 114. The vane material 112 and the support sheet 110, may be substantially any material and may be the same as each other or different from each other. For example, in some embodiments, the vane material 112 and the support sheet 110 may be a woven, non-woven material, fabric, or a knit material. Also, the vane material 112 and the support sheet 110 may consist of separate pieces of material sewn or otherwise attached together either in horizontally or vertical stripes, or in other shapes.

Additionally, the vane material 112 and the support sheet 110 may have varying light transmissivity properties. For example, the vane material 112 and/or the support sheet 100 may be made of a sheer fabric (allowing a substantial amount of light through), luminescent fabric (allowing some amount of light through), or a black-out fabric (allowing little or no light through). Both the vane material 112 and the support sheet 110 may also have insulating properties along with aesthetic properties. Further, the vane material 112 and the support sheet 110 may include more than one individual sheets or layers, and may be made of a different number of sheets or layers operably connected together. The vane material 112 may have a high level of drape (less stiff), or a low level of drape (more stiff), which may be selected for obtaining the appropriate or vane 107 shape. A more stiff vane material 112 may not result in as pronounced of a "S" shape as shown in FIG. 6A. As explained in more detail below, a less stiff vane material may result in a more pronounced "S" shape than shown in FIG. 6A.

In some configurations, such as shown in FIGS. 2 and 6A, the vanes 107, in combination with the support sheet 110 and adjacent vanes 107 may define the pseudo-cells 108. For example, a first vane 107 may have a bottom edge that may, in the extended position, touch a top surface of a second lower adjacent vane 107. Thus, the pseudo cells 108 may be defined by the support sheet 110, the vane material 112 of a first vane 107*a* and a second vane 107*b* adjacent to and immediately below the first vane 107A. The back surface of the top edge of the first vane material 112 of the first vane 107*a* is attached along its length, either continuously or intermittently, to a front surface of the support sheet 110 by a vane connection mechanism 122. Each pseudo cell 108 has, as oriented when positioned over a window in a building, a front side (e.g., a side facing the room) that is defined as the portion between the top juncture (vane connection mechanism 122) of the vane material 112 with the support sheet 110 and a bottom edge 125 of the vane 107. Each pseudo-cell 108 has a back side (e.g., facing the window), defined as the portion of backing sheet 110 extending between its juncture (connection line 122) with the vane fabric at its top and continuing down to the bottom edge 125 again.

With specific reference to FIG. 2, the vanes 107 may have a dimension Hc extending from the top edge of the first vane material 112 to a bottom edge 125. The dimension Hc represents the overall linear height of the vane 107 along the length of the support sheet 110 (vertical in this orientation, but may be a horizontal width where the invention is applied laterally to an architectural opening). Additionally, an adjacent lower vane may extend past the bottom edge of an upper vane 107 by an overlap dimension of Ho. The dimension Ho may be the distance between the bottom edge 125 and the top edge of the lower vane 107. The dimension Ho represents the linear height along the support sheet 110. It is contemplated that both Hc and Ho may be measured along the curvilinear surface of the vane also.

The value of Ho, whether as a percentage of Hc, or an absolute value, affects the external appearance of the shade, among other things. Where Ho is relatively large (ratio or dimension), it will result in less of the height (in reference to FIG. 2) of the front vane material 112 of the vane 107 being shown. Where Ho is relatively low (ratio or dimension), it will result in more of the height of the front vane material 112 of the vane 107 being shown. The dimension Ho can be designed to be consistent for a length of a shade, or may vary, depending on the desired aesthetic effect.

Additionally, the value of the dimension Ho may effect the distance that the vane material 112 extends away from the support material 110, which would affect the volume of the pseudo-cell 108 and the distance that the vane 107 may extend away from the support sheet 110, and thus may affect the insulative properties of the pseudo cells 108. Other features of the shade structure may also work together with the Ho value to affect the distance that the vane 107 may extend away from the support sheet 110. Also, the value of Ho affects how many layers the light must pass through as it strikes the rear of the support sheet 110. In the range of Ho, the light passes through three layers, for instance with regard to FIG. 2. Outside the range of Ho, the light passes through two layers. This may affect the appearance of any "light stripe" or shadow on the shade As shown best in FIGS. 6A and 6B, the front surface of the first vane material 112 may be positioned, but disconnected from, a front surface of the vane material 112 of the second vane 107*b*. The position of the first vane 107 relative to the second vane 107*b* may form the pseudo-cells 108 since the top vane material 112 may appear in an extended position to be attached to the second vane 107*b*, thus forming a "cell." In one example, a bottom edge 125 of the first vane 107*a* may rest on a top surface of the vane material 112 of the second vane 107*b*. However, because the top vane 107*a* may not be directly connected to the bottom vane 107*b*, the two vanes 107 may move relative to the other vanes 107. For example, the first vane 107*a* may extend away from the support sheet 110 without substantially causing the second vane 107*b* to also extend away from the support sheet 110.

The vane material 112 of the second vane 107*b* is attached by the vane connection mechanism 122 generally along a top edge to the front side of the support sheet 110. The top edge of the vane material 112 of the second vane 107*b* is positioned on the support sheet 110 at about the mid-point of the height H1 of the first vane 107*a* This position may be higher or lower depending on the desired vane shape. The shape of the pseudo-cells 108 are thus formed by the combination of the vane material 112 of the first vane 107*a*, the support sheet 110, and the top portion of the vane material 112 of the second vane 107*b*. The chamber 105 cross-section is approximately tear-drop shaped with a narrow top portion and a more bulbous bottom portion. In other embodiments, the shape of the chamber 105 may be differently configured and/or reduced.

FIGS. 4 and 5 show the vane material 112, the support member 114, and the support sheet 110 prior to forming. FIG. 4 is an exploded view of the support sheet and vane 107. FIG. 5 shows a vane connection mechanism 122 positioned on the top portion of the vane material 112. The vane connection mechanism 122 is positioned a distance from the top edge of the vane material 112 in order to form a leg 124 (see FIG. 6A) or free edge of the vane material 112 above the location where the vane material 112 is attached to the support sheet 110.

Referring to FIGS. 6A and 6B, the vane connection mechanism 122 may have a height of H3, rather than a single line of connection having little width (a relatively thin line). Where the connection mechanism 122 has a height H3, it provides a bonding force between the vane material 112 and the support sheet 110 over its height H3, which bonding force helps maintain the vane material 112 in closer proximity to the support sheet 110 even under the bending load biasing the vane material 112 away from the support sheet 110 caused by the vane material 112 of the adjacent upper vane. In these instances, the vane connection mechanism 122 may facilitate the vane 107 refinancing in a more "closed" configuration when the shade is extended. That is, the bottom edge 125 of the vane 107 may be biased towards the top surface of the vane material 112 of the adjacent lower vane 107. This is because the height H3 may help prevent the vane material 112 from extending away from the support sheet 110, which could allow adjacent vanes 107 to extend away from each other, and thus "opening the pseudo cells" and potentially releasing air, reducing the insulative characteristics of the pseudo cells 108, as well as creating a less uniform appearance of the panel.

With reference again to FIG. 6A, as discussed above, the vane material 112*b* of the second vane 107*b* extend up the support sheet 110 to a height that may overlap with a height of the first vane 107*a*.

Additionally, the vane material 112 may form a general "S" shape. In some instances, the point of transition between the curve being concave towards the backing sheet 110 (where the support member 114 is positioned on the vane), and concave away from the support sheet 110 (above the support member 114) is defined by where the vane 112 is bonded to the upper end of the support member 114.

Referring to FIGS. 2, 3, and 6A, the support member 114 may support the vane material 112 and help form the shape of the vanes 107. The support member 114 may be a partially or substantially rigid material that may retain a particular shape. The support member 114 is resilient in that it may be bent or flexed from its normal shape and return to its formed shape. For example, the support member 114 may be any thermoformable material that may be heated to form a particular desired shape. Also, the support member 114 may be re-formable, allowing the general shape of the support member 114 to be altered repeatedly. Forming the support member 114 is discussed in more detail below.

The support member 114 may extend along at least a portion of the vane material 112 between the locations of the vane connection mechanisms 122 and the bottom edge 125 of the vane 107. In some examples, the vane material 112 may be sufficiently stiff (have structural properties) so that the "S" shape is formed in spite of the weight of the support member 114 and vane below it. In this way, the rigidity of the support member 114 creates a twist or torque at its upper junction with the vane material 112, and the stiffness of the vane material 112 as it extends upwards from this point is levering the entire vane 107 assembly outwards (laterally away from the backing sheet 110), creating a deeper chamber 105 or distance from the support sheet 110 than if the vane 107 had been defined by the curve of the support member 114 itself. The support member 114 and the vane material 112 may be operably connected together at support connection mechanism 120. The support connection mechanism 120 may be adhesive, fasteners, stitching, and the like. In other embodiments, the support member 114 may be molded onto or impregnated into the vane material 112, as discussed in more detail below.

In some embodiments, the support member 114 may be plastic, moldable laminate, fibers, moldable tape, adhesive, polyvinyl chloride, polypropylene, or the like. For example, the support member 114 may be a thermoformable material such as a laminate material and may have an adhesive-like property when heated and then cooled. In other examples, the support member 114 may be a partially thermoformable material that may have an increased adhesive-like property when heated and/or cooled, but may not completely loose its original shape or structure during heating and/or cooling.

Furthermore, vane material 112 may also be impregnated with the support member 114.

Additionally, the support member 114 may be configured to have aesthetic properties. Similar to the vane material 112 and the support sheet 110, the support member 114 may have varying light transmissivity properties, e.g., the support member 114 may be sheer, clear, opaque, or black-out. In other embodiments, the support member 114 may be wood veneer. A vane material of wood veneer may be positioned on the outside of the vane material with the support material below it to create the shape. If the veneer was used without an additional support material, it may be formed to have a curved shape by being wetted, then rolled up onto a forming roller or tube, and dried in the oven heat to set the curvature of the veneer. This formation of the veneer may or may not be repeatable to reform the wood veneer with a different curvature. Furthermore, the support member 114 may have varying thicknesses, and in some embodiments, the support member 114 may be as thin or thinner than the vane material 112. In some embodiments, the support member may typically be approximately a 0.002 inch thick PET (polyester film). If made of another material (such as PVC), the thickness may be greater or less, with a thickness range of about 0.001 inches up to about 0.010 inches. In these embodiments, the vane 107 may remain substantially flexible and may be able to flex, bend, and/or wrap around the support tube, although the support member 114 may be a substantially/partially rigid material.

The support member 114, as shown in FIG. 6A, is positioned on the inner surface of the vane material 112 of the first vane 107*a*, facing the support sheet 110. In other instances, the support member 114 may be positioned on an outer surface of the vane material 112. In some embodiments the support member 114 may be formed integrally with the vane material 112 or may be applied on the outer surface of the vane 107. With reference to FIG. 3, the support member 114 is shown as a separate piece that is positioned in the vane material 112 towards the support sheet 110. It should be noted that the support member 114 may be positioned on the front surface of the vane material 112, or may be integrally formed with the vane material 112 (such as the vane material 112 being impregnated with a thermoformable material to allow it to become resiliently formed).

The support member 114 may extend laterally along the full length of the vane 107 (across the width of the panel 106). The support member 114 may also extend along a portion of the length of the vane 107, or may include a plurality of cell support members 114 positioned at discreet positions along the length of the vane 107.

The support member 114 may be adhered to the vane material 112 continuously along its entire length, continuously along a portion of its length, at spaced positions along its length, at the top and bottom edges of the support member 114, or in other locations. Varying the height as well as the placement of the support member 114 in the vane 107 may alter the shape of the vane 107 and chamber 105, as well as the distance or space between the support sheet 114 and the vane material 112 when the vanes 107 are extended away from the support sheet or "open." For example, a smaller support member 114 may create a smaller distance between the support sheet 114 and the vane material 112, which may make the vane 107 appear "flatter" as compared to a vane 107 having a larger support member 114.

Once the panel 106 is unrolled from the support tube 116, and vanes 107 are in their extended position, the curvature of the support material 114 effectively shortens not the length of the front side of the vane 107, but the straight-line distance between the bottom edge 125 and the top juncture (connection line 122).

One aspect of the slat structure disclosed herein is the constancy of appearance during retraction and extension of the shade panel from the support tube. In many instances, shades are retracted by stacking from the bottom-up, which changes the appearance of the shade at the bottom of the shade panel as it is compressed and collected by the lifting of the bottom rail. The same distortion of the shade occurs during extension of the stacked shade. In at least one example of the shade as described and disclosed herein, the appearance of the slats or pseudo-cells (individually and collectively) during retraction and extension are not substantially affected, and in some instances are not affected at all.

The shade panel, for instance 106 in FIG. 1, and also partially shown in FIG. 2, for instance, includes a panel of slats extending laterally and positioned above one another vertically. Each cell has a height and amount of curvature of the vane defined by at least in part by the curvature created by the cellular support material, as well as by the attachment locations of the vane material to the support sheet. This height and curvature creates a first appearance for the individual slats. Note that the individual slats may each have a different first appearance, or may have a similar or identical first appearance. The plurality of slats forming the shade panel also create an overall, or collective appearance, which may be created by two adjacent or non-adjacent slats, or more than two adjacent slats. The appearance of this collection of slats creates a second appearance.

Unlike the changing appearance of stacked cellular shade panels when refracted and extended, the appearance of at least one example of the slats disclosed and described herein does not substantially change upon extension or refraction. In other words, the appearance of individual slats or a collection of the slats, is not greatly affected by the amount the shade is extended, or the act of extending or retracting the slats. This constancy of appearance, both individually and collectively, is due to the use of the support tube to retract and extend the slats. Since the support tube is engaged with or operably associated with the top portion of the shade panel (such as by attaching to the support sheet), the appearance of individual slats and/or collection of slats are not changed substantially between the bottom of (or below) the support tube and the bottom rail positioned at the lower edge of the shade panel. Until actual engagement around the support tube (during retraction) the appearance of a particular slat is largely unchanged from it's appearance when the shade is fully extended. The collective appearance of the slats between the head tube and the bottom rail (other than the shade panel becoming shorter in length) is also largely unchanged. Similarly, upon extension from a retracted position, once a slat has been unwound from the support tube, its individual appearance is largely unchanged during extension below the head tube.

Unlike stackable cellular shades, in at least one example of the slat shade structure described and disclosed herein, the appearance of the individual slat or a collection of slats below or not engaging the support tube is largely unchanged during retraction and extension. The height, curvature or lateral depth (from front of the vane material to the support sheet, as created by chamber size) that together or individually create or affect the appearance of the individual or collection of slats are substantially unchanged. The effect is that the shade panel has a clean and consistent appearance not greatly affected by the vertical position (amount of retraction or extension) of the shade panel.

Forming the Panel

Referring now to FIGS. 3, 4, and 5, the panel 106 may be formed in a variety of different manners. However, in some embodiments, the support member 114 is formed so that it may be shaped to approximate an arc of curvature or outer perimeter shape for the support tube 116 as modified by any underlying layers of the cellular shade already wound around the support tube 116. For example, as shown in FIG. 4, prior to being formed (as will be discussed in more detail below), the support member 114 may be substantially flat (e.g., linear). However, as shown in FIG. 3, after forming, discussed in more detail below, the support member 114 may have a curvature or arcuate shape. This curvature or arcuate shape may be substantially the same as a portion of the perimeter of the support tube 116 or other forming mandrel or tube. In these embodiments, as the vanes 107 are wound around the support tube 116, the support member 114 may be wound around the support tube 116 although it may be substantially or partially rigid or resilient. Because the support members 104 are resiliently flexible, they may conform to various different shapes when wound up, such as a greater or lesser radius of curvature. Because the support member 114 may substantially approximate the same radius of curvature as the support tube 116 (due to the forming process, discussed below), each support member 114 may wrap around a portion of the support tube 116 (as well as any vanes 107 already wrapped around the support tube 116). Specifically, as the diameter of the support tube 116 and the rolled shade increases, the radius of curvature for the support member 114 changes, so that the radius of curvature for vanes 107 near the top of the shade have a tighter radius than those at the bottom.

The support members 114 may be formed (or re-formed) around the support tube 116 to create the desired formed shape. In some embodiments, before the support member 114 is formed it may be substantially flat and thus the vanes 107 may lay generally directly against the support sheet 110. Due to the at least partial resiliency of the support member 114, the support members 114 may not break or crack while being wound around the support tube 116 prior to forming.

To form the panel, the vanes 107 may be operably connected to the support sheet 110 prior to the support members 114 being formed and/or wound around the support tube 116. For example, the connection member 122, which may be adhesive, may be applied onto either the vane materials 112 or the support sheet 110. The panel 106 may be formed by aligning the support members 114 with the vane materials 112, applying the support connection mechanism 120 to the support member 114 and the vane material 112. Then, the vane material 112 may be connected to the support sheet 110 by the vane connection mechanism 112. For example, in instances where the vane connection mechanism 122 is an adhesive, the adhesive lines may be applied to the support sheet 110. Once the connection mechanism 120, 122 are applied to one of the vane material 112, support member 114, and/or support sheet 110, the panel 106 or portions thereof may be heated or otherwise (e.g., by a bonding or melting bar) to a first temperature (or otherwise activated) to adhere the vane material 112 and the support sheet 110 together.

As a specific example, a melting bar or a bonding bar may apply pressure and/or heat to activate the connection mechanisms 120, 122 (which in some instances may be heat and/or pressure activated). In some instances, the connection mechanisms 120, 122 may have a high activation or melting temperature, for example approximately 410 degrees Fahrenheit. This first temperature may be higher than a second temperature used to form the support members 114, discussed below.

Once the vane material 112 and the support sheet 110 are connected together, the panel 106 may be wound around the support tube 116. After the panel 106 is wrapped around the support tube 116, the support tube 116 and the panel 106 may be heated to a second temperature, which may be less than the first temperature. For example during this operation, the panel 106 may be heated in this process to a temperature of approximately 170 to 250 degrees Fahrenheit, for up to approximately one and one-half hours. A temperature of 175 to 210 degrees Fahrenheit for approximately 15 minutes has been found to be suitable in some circumstances. Other temperatures and times may be acceptable as well.

As the panel 106 is heated, the support members 114 may become formable and conform to the support tube 116. As the support member 114 material is heated it may conform to the shape of the support tube 116, as well as operably connect to the vane material 112 (if not already connected together). Additionally, in some embodiments, the support member 114 may conform to the shape of the support tube 116 plus any layers of the panel 106 it may be wrapped around. For example, the cell support members 114 for the cells 108 in an outer most layer of the panel 106 may have a larger diameter of curvature than the cell support members 114 for vanes 107 at an inner-most layer.

In some instances the connection mechanisms 120, 122 may be activated at a higher temperature than the forming temperature of the support member 114. In these instances, the support members 114 may be formed without substantially affecting the connection of the vanes 107 to the support sheet. Thus, the support members 114 may be formed after the panel 106 has been substantially assembled and/or connected together. For example, the connection mechanism 120, 122 may be high temperature pressure set adhesive, which may allow for the support member 114 to be formed by a heated processes, without substantially weakening or destroying a connection between the vane material and the support sheet. For example, the vane connection mechanisms 120, 122 may have a higher melting point than a material used to form the support member 114. In one instance, the melting point for the vane connection mechanism 122 may range between 350 and 450 degrees Fahrenheit and in a specific instance may be 410 degrees Fahrenheit. This allows the support member 114 to be formed and possibly reformed at the necessary temperature without affecting the adhesion properties of the vane connection element.

After heating the panel 106, the support tube 116 may be cooled. During cooling, the support members 114 may stiffen or harden in the shape of the support tube 116. This is because the support members 114 may become at least partially formable or moldable when heated, but after the heating process the support members 114 may harden back into a substantially resilient shape.

Once cooled, the support member 114 may maintain the general shape of the support tube 116 and thus be slightly curved. Thus, after forming of the support member 114, the vanes 107 may be curved as shown in FIG. 6A. This allows the support member 114 to be wrapped around the support tube 116 when in a stored or retracted position because the shape of the support member 114 generally conforms to the support tube 116. The support members 114 then, as described below, help bias their respective vanes 107 away from the support sheet 110 to an open position when unwound from the support tube 116.

For example, in some embodiments, the support member 114 may be shaped generally as a portion of a "C", thus, as the panel 106 wraps around a cylindrically shaped support tube, the support member 114 may conform to a portion of the perimeter of the support tube 116. This facilitates the vanes 107 to be wrapped or rolled around the support tube 116 in the retracted position, and also to extend away from the support sheet 110 to "open" as the panel 106 is unwound from the support tube 116. The resistance of the support member 114 and its connection to the support sheet aids in the automatic-open features.

The panel 106, while originally formed around a support tube 116, may be disconnected from the original support tube and re-attached to a different support tube (such as having a larger or smaller diameter support tube) for subsequent reforming. The top edge of the panel 106 may be attached to a new support tube 116 or by a hem received in a slot, or other means. Also, if a portion of a panel 106 is separated from a larger length of panel 106 by a lateral slice along the width of the panel 106, the now separate panel 106 may be attached to a new support tube (such as by the means described herein) having the same diameter as the original support tube, or it may be attached to a new support tube having a different diameter than the original support tube and be reformed.

After the support members 114 are formed and the panel 106 is operably connected to the support tube 116, a panel section of different widths may be formed by cutting the combination of the wrapped panel 106 and support tube 116 to the desired length. In these embodiments, end caps or the like may be placed on the terminal ends of the support tube 116 creating a refined appearance. For example, a single support tube 116 may be used to create multiple different panels or shades for a variety of different architectural openings.

Operating the Panel

Operation of the panel 106 will now be discussed in more detail. As discussed above, the panel 106 may be wound around the support tube 116 or other member (e.g., rod, roller, mandrel, etc.). See, for example, FIG. 9, among others. As the vanes 107 are wound around the support tube 116, the vanes 107 the support sheet 110 may collapse into the vanes 107 so that each vane 107 may substantially conform to a perimeter of the support tube 116. This is possible as the support sheet 110 may wrap tightly around the support tube 116, and as it does so, the support sheet 110 collapses into the vanes, which then wrap around the support tube 116. As the support tube 116 winds (or rolls), the support members 114 may then be forced to conform to the effective perimeter of the support tube 116 and underlying layers of the shade. Thus, the support members 114 may be collapsed to lie adjacent the support sheet, substantially collapsing the chamber 105 formed between the vanes 107 and the support sheet 107 when the panel 106 is in the extended position.

Continuing with reference to FIG. 6A, as the panel 106 is unwound from the support tube 116, e.g., extended, the vanes 107 extend away from the support sheet 110 to create the chamber 105 and pseudo cells 108. As the support tube 116 is rotated to extend the panel, the support sheet 110 also unwinds. As the support sheet 110 unwinds, the support members 114 also unwind from around the perimeter of the support tube 116. On the support tube 116, the shade material is collapsed into closely spaced layers (and the support members 114 generally maintain a same or similar amount of curvature as when in the extended position. As shade or panel 106 is extended as the support tube 116 rotates accordingly, the backing or support sheet 110 hangs substantially vertically downwardly. The vane material 112, under the force of the support member 114, converts to the open configuration and extends away from the support sheet 110 to define the chamber 105 and pseudo cells 108. This expanded or open shape is caused by the support material 114, in combination with the structural effect on the vane material 112 of the top connection points, as described in more detail below. To the extent that any of the support members 114 are deformed when rolled up on the support tube 116, the resiliency of each of the support members 114, upon unrolling, biases the vane material 112 to its formed shape, e.g., similar to a "C" to create the chamber 105. The support member 114 and the vane material 112 thus extend away from the support sheet 110 to form the pseudo cell 108 and interior chamber 105.

In some embodiments, a portion of the vane material 112*b* for the second vane 107*b* may extend up behind the first vane 107*a* and connect to the front surface of the support sheet 110. This top edge of the vane material 112*b* for the second vane 107*b* may be connected to the front side of the support sheet 110 by the vane connection member or rear connection mechanism 122. The vane connection mechanism 122 may be approximately at a mid-point of the first vane 107*a*. The vane material 112 may connect to the support sheet 110 such that there may be a leg 124 or free edge that may extend above the vane connection mechanism 122.

Referring to FIGS. 6A and 6B, while the leg 124 may (but is not required to) assist the vanes 107 in expanding into an "open" position (i.e., transitioning from a collapsed position to an expanded position), the leg does provide dimensional tolerance for applying a connection mechanism 122 (such as a glue or adhesive line) along the edge. In some instances the panel 106 may also be retracted in a stacked configuration, rather than wound around the support tube 116. See, e.g., 11. In this configuration, each vane 107 or slat may be positioned in a relatively straight alignment vertically underneath one another. For example, the end rail 104 (or terminal vane) may be moved vertically upwards towards the head rail 102 or support tube 116. This may be accomplished by one or more support cords extending from the head rail 102 (or other suitable structure at or near the top of the shade) through the length of the panel 106 and connecting to the end rail 104. The support cords are then actuated to pull the end rail 104 up toward the head rail 102, thus stacking the vanes 107 as shown. Many known mechanisms are suitable for drawing the support cords to the head rail 102. And thus, rather than winding around the support tube 116, the panel 106 may stack vertically in a line. Thus, each vane 107 or slat may collapse vertically on top of each adjacent vane 107.

Alternative Examples of the Panel

Figure 7:
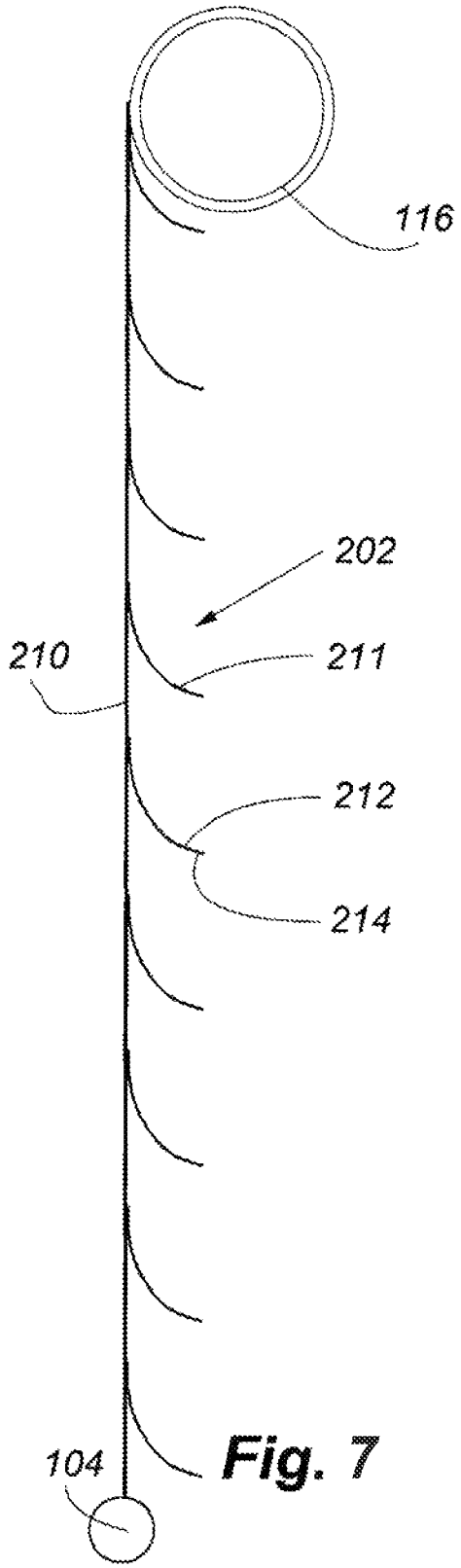
FIG. 7 is a side elevation view of a second embodiment of a panel for covering an architectural opening.

FIG. 7 illustrates another embodiment for a panel covering for an architectural opening. In this embodiment, the vanes or slats including a slat support 214 and/or vane material 212 may be operably connected to a support sheet 210 to form an architectural covering that may be used to prevent light from directly entering into a window or the like. In this embodiment, rather than having pseudo-cells 108 or have the vanes 107 oriented downwards towards the end rail 104, the panel 202 may include slats 211. The slats 211 may be substantially similar to the vanes 107, but may be curved or generally shaped as a portion of a "C" shaped so that the slats 211 may curve upwards towards the support tube 116. For example, a middle portion of each slat 211 may be lower on the panel 202 (with respect to the support tube 116) than a top of each slat 211. In these embodiments, the slats 211 may be shaped so that they may be rolled around the support tube 116 when the panel is in a retracted position. For example, as shown in FIG. 7, the slats 211 may have substantially the same curvature as the support tube 116, so that as the panel is wound around the support tube 116 the slats 211 may be positioned around the support tube 116.

The slats 211 may include the a slat support layer 214 and a vane material 112. The vane material 112 may cover the entire slat support layer 214 or just a portion of the slat support 214. In other embodiments, the slats 211 may include only the slat support layer 214. The slats 211 may each be operably connected to the support sheet 210, for example, via adhesive, fasteners, stitching, and so on.

The slat support 214 may be substantially the same as the support member 114. For example, the slat support 214 may be a thermoformable material that may become resiliently flexible after it is formed. These embodiments allow the slat support 214 to support and maintain a shape of the slats 211. For example, as shown in FIG. 7, the slats 211 may be curved upwards towards the support tube 116 and (as the cells support 214), the slats 211 may be partially resilient, so that each slat 211 may remain in a particular shape.

Figure 8:
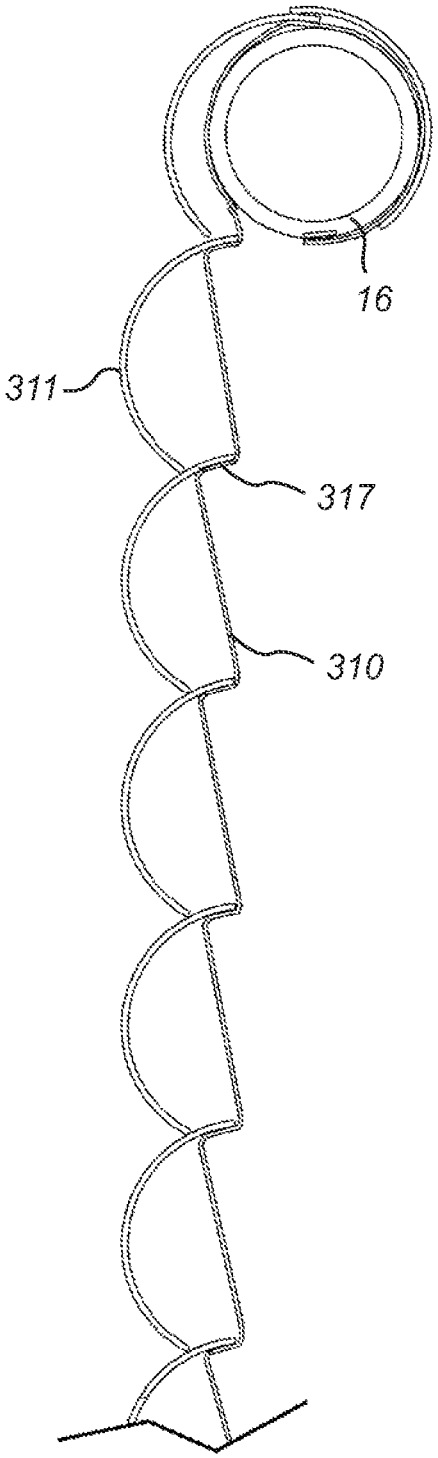
FIG. 8 is a side elevation view of a third embodiment of a panel for covering an architectural opening.

FIG. 8 illustrates another embodiment of a panel for an architectural opening. In this embodiment, a series of slats 311 or vanes may be curved downwards or away from the support tube 116. In this embodiment, the slats 311 may be oriented similar to the vanes 107 illustrated in FIG. 1, but may be more "C" shaped rather than "S" shaped. In this embodiment, the slats 311 may also form pseudo cells as each slat 211 may rest against (or above) each preceding slat 311; however, the slats 311 may not be directly connected to one another. For example, each slat 311 may be operably connected to the support sheet 110 (e.g., through adhesive, stitching, etc.) along a top edge thereof, but may not be fixedly connected to adjacent slat 311. These embodiments allow the slats 311 to rotate or flex open. Additionally, as shown in FIG. 8, the support sheet 310 may include steps 317 at the connection location of each slat 311. The steps 317 may be formed as a connection mechanism 122 for connecting the slats 311 to the support sheet 310 may extend along an interface to pull the support sheet 310 outwards a distance along the connection to the slats 311. Thus, the support sheet 310 may be stepped downwards, because the slats 311 may pull a portion of the support sheet 310 forward at the connection location.

Figures 9, 10:
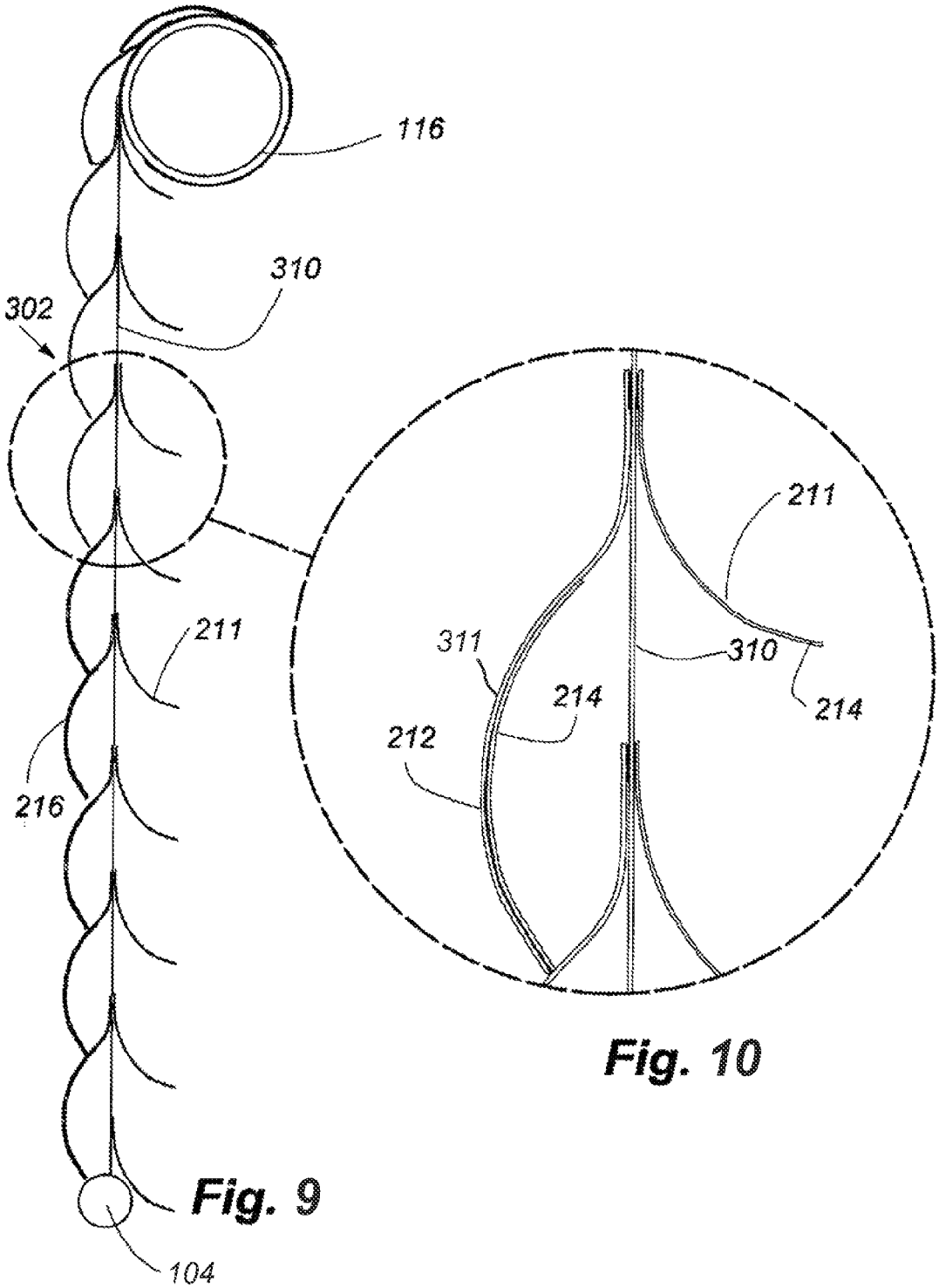
FIG. 9 is a side elevation view of a fourth embodiment of a panel for covering an architectural opening.
FIG. 10 is an enlarged view of the panel for covering an architectural opening illustrated in FIG. 9.

FIGS. 9 and 10 illustrate another embodiment of a panel 302 for an architectural opening. In this example, a single support sheet 310 may support two sets of slats 211, 311 and/or vanes 107. For example, a back side of the support sheet 310 may include slats 211 that extend outwardly and curve upwards towards the support tube 116 and a front side of the support sheet 310 may include slats 311. As illustrated in FIG. 9, the slats 211 or vanes on the back of the support sheet 310 may be curved downwardly and operably connected to a front side of the support sheet 310. In these embodiments, if the architectural opening is a window, the slats 211 may prevent direct rays of light from passing through the support sheet 310. The slats 211, 311 may provide insulation as well as being aesthetically pleasing. For example, the slats 311 may be shaped as quasi-cells or pseudo-cells, see e.g., FIG. 8. Thus, the panel 302 may be a dual-function architectural covering in that it may prevent direct rays of light from passing through the support sheet 310 as the slats 211 may substantially block direct light rays and it may provide insulation via slats 311, which may be configured to form quasi-cells. Additionally, the slats 211, 311 of FIG. 8 or 9 may be operably connected to the panel 106 of FIG. 6A. In this embodiment, the slats 211, 311 may be connected to an opposite side of the support sheet 110 from the vanes 107.

Figure 11:
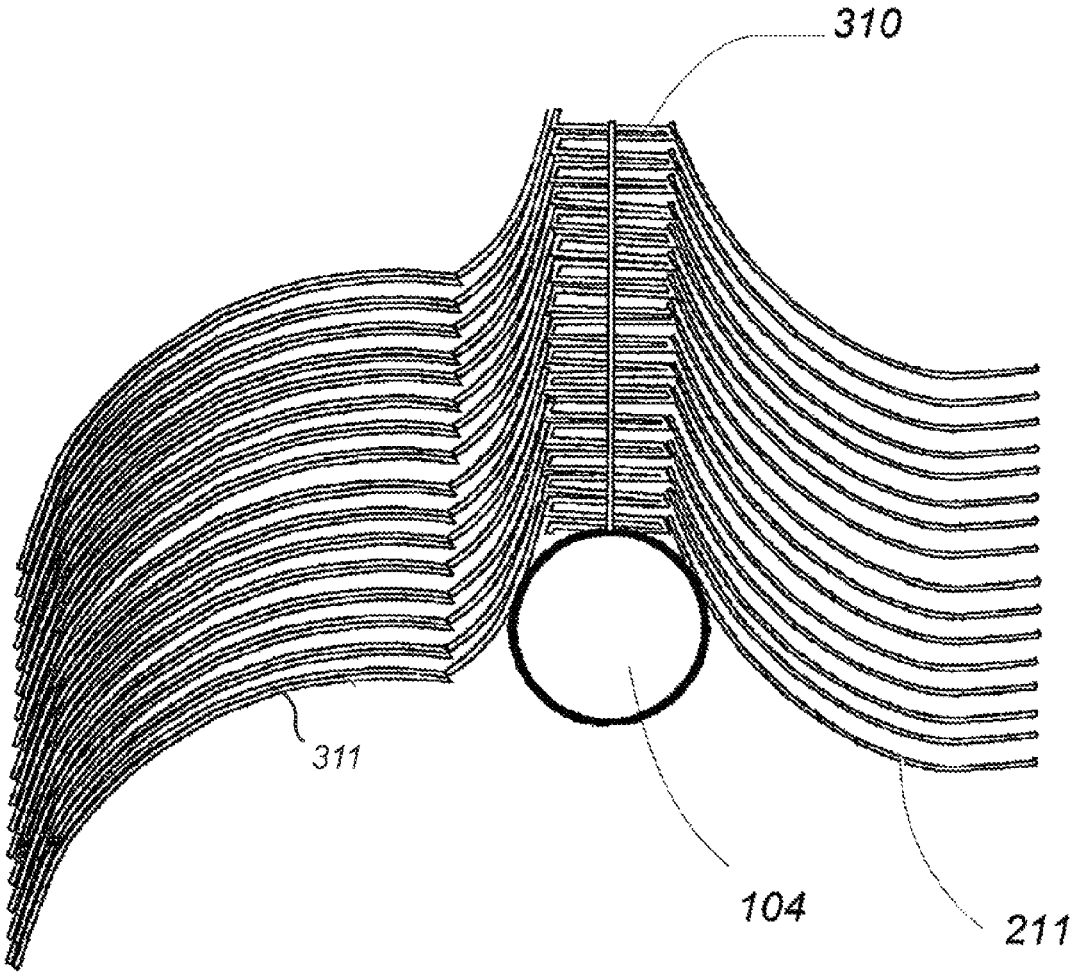
FIG. 11 is a section view of the panel of FIG. 10 retracted in a stacked configuration.

As described above, each of the slats 311 may open as each slat 311 may not be fixedly attached to adjacent slats 311. This allows the panel to be placed in a stacked position when retracted. For example, FIG. 11 illustrates the panel of FIG. 10 in a retracted position. To stack the panel, the end rail 104 may be pulled vertically up towards the support tube 116, (e.g., by retraction lines or cords), and rather than rolling the panel around the support tube 116. In this manner, the panel may be stacked so that each slat 211, 311 may be positioned underneath one another. As the panel 302 is retracted, the slats 211, 311 extend upward and outward and may positioned directly adjacent to one another.

Furthermore, as shown best in FIG. 10, in some examples, the slats 211 formed on a back surface of the support sheet 310 may include only a slat support structure 214, and the vane material 112 may be omitted. In these embodiments, the slat support structure 214 may include a pattern, color, or the like (in other words, may be aesthetically pleasing). The slats 311 formed on the front side of the support sheet 310 may include a slat support 214 that may be partially covered or completely covered by the vane material 112. For example, the vane material 112 may wrap around the slat support 214 or may terminate at an end of the slat support 214.

Figure 12:
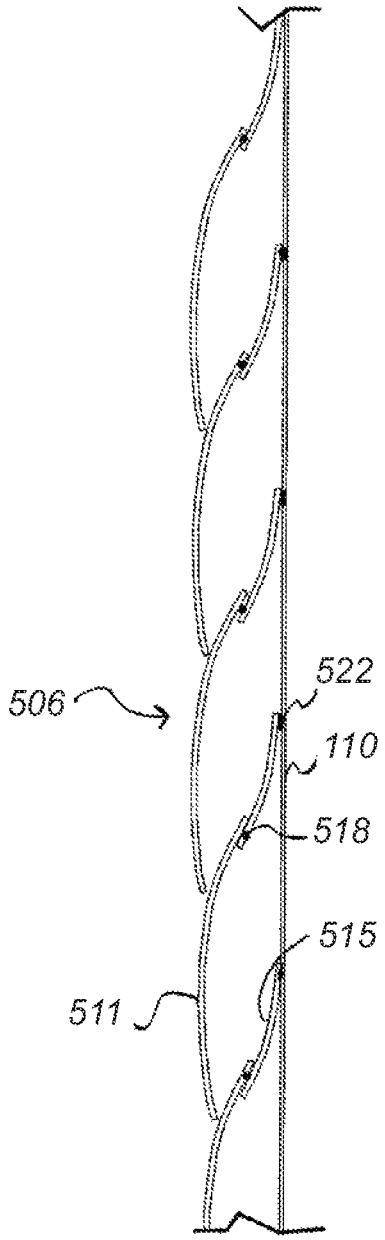
FIG. 12 is an elevation view of a fifth embodiment of a panel for covering an architectural opening.

FIG. 12 illustrates another example of a panel 506 for covering an architectural opening. The panel 506 may include slats 511 or vanes that may be operably connected to the support sheet 110 by a connection member 515, effectively making the slats 511 be made of a two-piece construction. In this embodiment, an effective length (as measured along the vertical length of the panel from the head rail to the floor) of the slats 511 with respect to the support sheet 110 may be extended, because the connection member 515 extends an appearance of the length of each slat 511. The connection member 515 may also extend the slats 511 away from the support sheet 110, so that the panel 506 may have a larger overall width (as measured between the backing sheet and the slats) than other embodiments. The connection member 515 may be operably connected to the support sheet 110 via an adhesive 522 or other attachment means, and to the slat 511 by an adhesive or other attachment means. The connection member 515 may be similar to the vane material 112 or may otherwise be a generally flexible material that is configured to be wound around the support tube 116.

Each slat 511 may be operably connected to the support sheet 110, but may not be operably connected to other slats 511. As such, similar to the vanes 107, the slats 511 may form quasi-cells, in that when the panel 506 is in an extended position the slats 511 may create a pocket or chamber, but when retracted, the slats 511 may extend away from the other slats 511. The slats 511 may be positioned so that they may curve or arc towards the support sheet 110; however, the arc of curvature may minimized as compared with the slats 511 illustrated in FIGS. 7 and 8. For example, the slats 511 illustrated in FIG. 12 may be slightly rounded, rather than having a more pronounced curve as the letter "C". The connection member 515 may be curved having a concave side facing generally away from the backing sheet 110, with the slat 511 being curved and having a concave side facing generally toward the backing sheet 110. The slat 511 and/or the connection member 515 may have more than one curve along their respective lengths.

The slats 511 are operably connected via an adhesive strip 518, the adhesive strip 518 may be positioned on an upper outer surface of the connection member 515 and a bottom surface of an upper portion of each slat 511. As the slats 511 are curved towards the support sheet 110, the adhesive strip 518 may be partially encased as the adhesive strip 518 may be positioned between the top surface of the connection member 515 and a bottom surface of the slat 511.

It is contemplated that the shade may be retracted or extended by either control cords or by a motor drive system. Using control cords, the control cord(s) would allow manual retraction or extension by a user to the desired position. The control cord(s) engage and actuate a drive mechanism operably associated with the support tube, and positioned in or adjacent the head rail. The drive mechanism may include a clutch (coil spring or otherwise) and transmission (such as a planetary gear mechanism) to improve the gear ratio and allow retraction and extension with less load on the control cord.

In the motor drive system, a motor turns the support tube to retract the shade panel by winding it around the support tube during retraction, and turns the support tube to unwind the shade panel from the support tube during extension. The motor drive system may include a drive mechanism, such as an electric motor (which may or may not be reversible), which is operably associated with the support tube. The motor may be integrated into the support tube, or may be separate from the support tube (in axial alignment or not). The motor is shown engaged with an axle mounted in the support tube by a belt drive, but it is contemplated that a gear drive mechanism, planetary gear mechanism, or the like may also be utilized. The motor is supplied with electric power from a battery source, line voltage, or otherwise, and its operation to retract or extend the shade panel is controlled by the user through a manual switch (wired or wireless), or automated through a motor controller. The motor controller may be in communication with and controlled by a programmable logic controller, which may include a processor to allow for direct control from a user, as well as software-based control instructions responsive to real-time control signal(s) from associated sensor(s), or pre-programmed signals from a control program. Additionally, the controller may be in communication with the internet or dedicated local communication system to allow for remote control by a user, either manually or automatically. The control signals provided to the motor manually or through the motor controller may be wired or wireless (e.g. RF, IR, or otherwise as is known). The motor controller may be in wired communication with the motor, and the logic controller may be in wired communication with the logic controller, each being discrete elements of the system. It is contemplated that the motor controller and the logic controller may be integrated into the motor (a "smart" motor), which would allow for fewer components and smaller overall system. The motor-controlled retraction of the shade panel would thus control the retraction and extension of the cellular shade panel as defined herein by being wound and unwound around a support tube. This action may be implemented without the use of any manual control cords and the associated maintenance, potential breakage, and other issues associated with use of control cords.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

What is claimed:

1. A covering for an architectural opening comprising:
a panel comprising:
a support sheet; and
at least an upper vane and a lower vane connected to the support sheet, each of the at least upper vane and lower vane comprising:
a flexible vane material operably connected to a first side of the support sheet; and
a support member operably connected to an inner surface of the vane material and configured in a resilient arcuate shape to support the vane material at a distance away from the support sheet when the panel is in an extended position with respect to a support tube and to conform the flexible vane material to the arcuate shape of the support member when the panel is in the extended position with respect to a support tube;
wherein:
the upper vane includes an unattached bottom edge extending downwardly towards the lower vane;
the unattached bottom edge of the upper vane rests on the lower vane; and
the support member operably connected to the vane material of the upper vane contacts the lower vane when the panel is in the extended position.

2. The covering of claim 1, wherein the support member is a thermoformable material.

3. The covering of claim 1, further comprising a support tube, wherein the panel is operably connected to the support tube and configured to be wound around the support tube.

4. The covering of claim 3, wherein the support member comprises an arc of curvature that is substantially the same as an arc of curvature for the support tube.

5. The covering of claim 1, wherein the at least upper vane and lower vane are configured to extend away from the support sheet to an open position defining a chamber between the support sheet and each of the respective support members when the panel is in an extended position.

6. The covering of claim 5, wherein the support sheet is configured to substantially collapse into the at least upper vane and lower vane, substantially decreasing a size of the respective chambers when the panel is in a retracted position.

7. The covering of claim 1, wherein the vane material and the support member are integrally formed together.

8. The covering of claim 1, wherein:
the upper vane includes:
a first support member; and
a first vane material operably connected to the first support member, the first vane material having a first top portion, a first middle portion, and a first bottom edge, wherein:

the first top portion is operably connected to the support sheet adjacent a first top edge of the first vane material defining a first leg;

the first top portion extends downwards adjacent the support sheet and at a first inflection point transitions away from the support sheet to the first middle portion; and the first middle portion transitions at a second inflection point to the first bottom edge; and the lower vane includes:

a second support member; and a second vane material operably connected to the support member, the second vane material having a second top portion, a second middle portion, and a second bottom edge, wherein:

the second top portion is operably connected to the support sheet adjacent a second top edge of the second vane material defining a second leg;

the second top portion extends downwards adjacent the support sheet and at a third inflection point transitions away from the support sheet to the second middle portion; and the second middle portion transitions at a fourth inflection point to the second bottom edge.

9. The covering of claim 8, wherein:

the lower vane is positioned below the upper vane; and in the extended position the first bottom edge is positioned adjacent to the second top portion and the second middle portion and the second top portion extends upwards on the support sheet to approximately a centerline of the first vane.

10. The covering of claim 9, wherein:

the first support member extends along at least a portion of the first vane material between the first bottom edge and the first inflection point; and the second support member extends along at least a portion of the second vane material between the second bottom edge and the second inflection point.

11. The covering of claim 8, wherein the first support member and the second support member are both a thermoformable material.

12. The covering of claim 1, wherein the support member is spaced below a top edge of the vane material.

13. The covering of claim 1, wherein the support member is connected to the vane material approximately in line with where the vane material is connected to the support sheet.

14. The covering of claim 1, wherein a top edge of the vane material is connected to the support sheet via a vane connection member.

15. The covering of claim 14, wherein the vane connection member is separate from, and extends along the length of, the vane material.

16. A covering for an architectural opening comprising:

a support sheet; and at least an upper slat and a lower slat operably connected to and extending from the support sheet, each of the at least upper slat and lower slat including:

a vane material connected to the support sheet and having a first rigidity; and a support member having an arcuate shape and operably connected to at least a portion of the vane material and having a second rigidity, the vane material conforming to the arcuate shape of the support member;

wherein:

the support member is spaced a distance from the connection of the vane material to the support sheet, and the vane material is sufficiently stiff such that the vane material levers the support member away from the support sheet;

the first rigidity is less than the second rigidity;

the upper slat includes an unattached bottom edge extending downwardly towards the lower slat; and the support member of the upper slat and the support member of the lower slat at least partially overlap.

17. The covering of claim 16, further comprising a support tube, wherein:

the support sheet is operably connected to the support tube; and the support member has a curvature that at least partially conforms to a curvature of the support tube.

18. The covering of claim 17, wherein the at least upper slat and lower slat are operably connected to the support sheet such that a bottom edge of each of the slats faces towards the support tube.

19. The covering of claim 16, further comprising a plurality of vanes operably connected to and extending from the support sheet on a side opposite the at least upper slat and lower slat.

20. The covering of claim 19, wherein each of the plurality of vanes has a bottom edge that is angled in an opposite direction from a bottom edge of each of the at least upper slat and lower slat.

21. The covering of claim 19, wherein each of the plurality of vanes includes a vane support member that is at least partially resilient and in an extended position of the covering extends the vanes away from the support sheet at least at one location.

22. The covering of claim 16, wherein the curvature of the support member is generally "C" shaped.

23. The covering of claim 17, wherein the support tube is rotated by a motor drive system to retract the support sheet.

24. The covering of claim 17, wherein the support tube is rotated by a motor drive system to extend the support sheet.

25. The covering of claim 16, wherein:

the at least upper slat and lower slat has an appearance; and the appearance remains substantially unchanged during retraction of the covering.

26. The covering of claim 16, wherein:

more than one of the at least upper slat and lower slat creates a collective appearance; and the collective appearance remains substantially unchanged during retraction of the covering.

27. The covering of claim 25, wherein:

a bottom rail defines a bottom edge of the covering; and the at least upper slat and lower slat are adjacent the bottom rail.

28. The covering of claim 26, wherein:

a bottom rail defines a bottom edge of the covering; and a bottom-most slat of the more than one of the at least upper slat and lower slat is adjacent the bottom rail.

29. The covering of claim 16, wherein:

the support member is impregnated into the portion of the vane material.

30. The covering of claim 16, wherein:

the support member extends along an outer surface of the portion of the vane material.

31. The covering of claim 16, wherein:

the support member extends along an inner surface of the portion of the vane material.

* * * * *